US010155392B2

(12) United States Patent
Kamiya

(10) Patent No.: US 10,155,392 B2
(45) Date of Patent: Dec. 18, 2018

(54) SEALING MEMBER, INK CONTAINER, AND INKJET PRINTER

(71) Applicant: BROTHER KOGYO KABUSHIKI KAISHA, Nagoya-shi, Aichi-ken (JP)

(72) Inventor: Masataka Kamiya, Owariasahi (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/363,816

(22) Filed: Nov. 29, 2016

(65) Prior Publication Data

US 2017/0151796 A1 Jun. 1, 2017

(30) Foreign Application Priority Data

Dec. 1, 2015 (CN) ..... 2015 2 0984171 U

(51) Int. Cl.
*B41J 2/175* (2006.01)
*B41J 29/13* (2006.01)

(52) U.S. Cl.
CPC ..... *B41J 2/17506* (2013.01); *B41J 2/1752* (2013.01); *B41J 2/17509* (2013.01); *B41J 2/17523* (2013.01); *B41J 2/17553* (2013.01); *B41J 29/13* (2013.01)

(58) Field of Classification Search
None
See application file for complete search history.

(56) References Cited

U.S. PATENT DOCUMENTS

2016/0207318 A1 7/2016 Shirono et al.
2016/0264306 A1* 9/2016 Nishimaki ..... B65D 41/005

* cited by examiner

*Primary Examiner* — Erica Lin
(74) *Attorney, Agent, or Firm* — Merchant & Gould P.C.

(57) ABSTRACT

A sealing member for an ink container includes a main body portion and a protruding portion. The ink container includes a refill port. The main body portion is configured to seal the refill port. The protruding portion is disposed on an upper surface of the main body portion and protrudes from the upper surface of the main body portion. The protruding portion extends at least through a central axis of the main body portion. A center of gravity of the protruding portion is offset from the central axis of the main body portion.

16 Claims, 13 Drawing Sheets

SEALING MEMBER, INK CONTAINER, AND INKJET PRINTER

CROSS-REFERENCE TO RELATED APPLICATION

This application claims priority from Chinese Utility Model Application No. 201520984171.2, filed on Dec. 1, 2015, which is incorporated herein by reference in its entirety.

TECHNICAL FIELD

The disclosure relates to a sealing member, an ink container, and an inkjet printer.

BACKGROUND

Known inkjet printers typically include a main body and ink container that is fixedly attached to a side surface of the main body. The ink container includes an ink container body and a cover which is configured to pivot between an opened position and a closed position with respect to the ink container body. An ink refill portion, through which ink can be poured into the ink container body, is formed with the ink container body and includes an ink refill port and a sealing member which is configured to seal the ink refill port.

Before pouring ink into the ink container, it is necessary to pivot the cover to the opened position and remove the sealing member from the ink refill port. The user may hold the protruding portion and pull up the sealing member. Those user's actions may cause splashing the ink adhering to the sealing portion and contaminating the surrounding.

SUMMARY

The present disclosure describes a sealing member, an ink container, and an inkjet printer that may reduce various problems caused by using the conventional sealing member, ink container, and inkjet printer.

According to an aspect of the disclosure, a sealing member for an ink container may include a main body portion and a protruding portion. The ink container may include a refill port. The main body portion may be configured to seal the refill port. The protruding portion may be disposed on an upper surface of the main body portion and may protrude from the upper surface of the main body portion. The protruding portion may extend at least through a central axis of the main body portion. A center of gravity of the protruding portion may be offset from the central axis of the main body portion.

BRIEF DESCRIPTION OF THE DRAWINGS

Aspects of the disclosure are illustrated by way of example and not by limitation in the accompanying figures in which like reference characters indicate similar elements.

DETAILED DESCRIPTION

For a more complete understanding of the present disclosure, needs satisfied thereby, and the objects, features, and advantages thereof, reference now is made to the following descriptions taken in connection with the accompanying drawings. Hereinafter, illustrative embodiments of the disclosure will be described in detail with reference to the accompanying drawings. The terms "front", "back", "left", and "right" are used herein for the purpose of illustration and not of limitation. The terms "first" and "second" referenced herein are merely identification and do not have any other meaning, such as a particular order. For example, the term "first component" does not imply the presence of "second component", and the term "second component" does not imply the presence of "first component". The term "horizontal" referenced herein means substantially "horizontal".

First Embodiment

Figure 1:
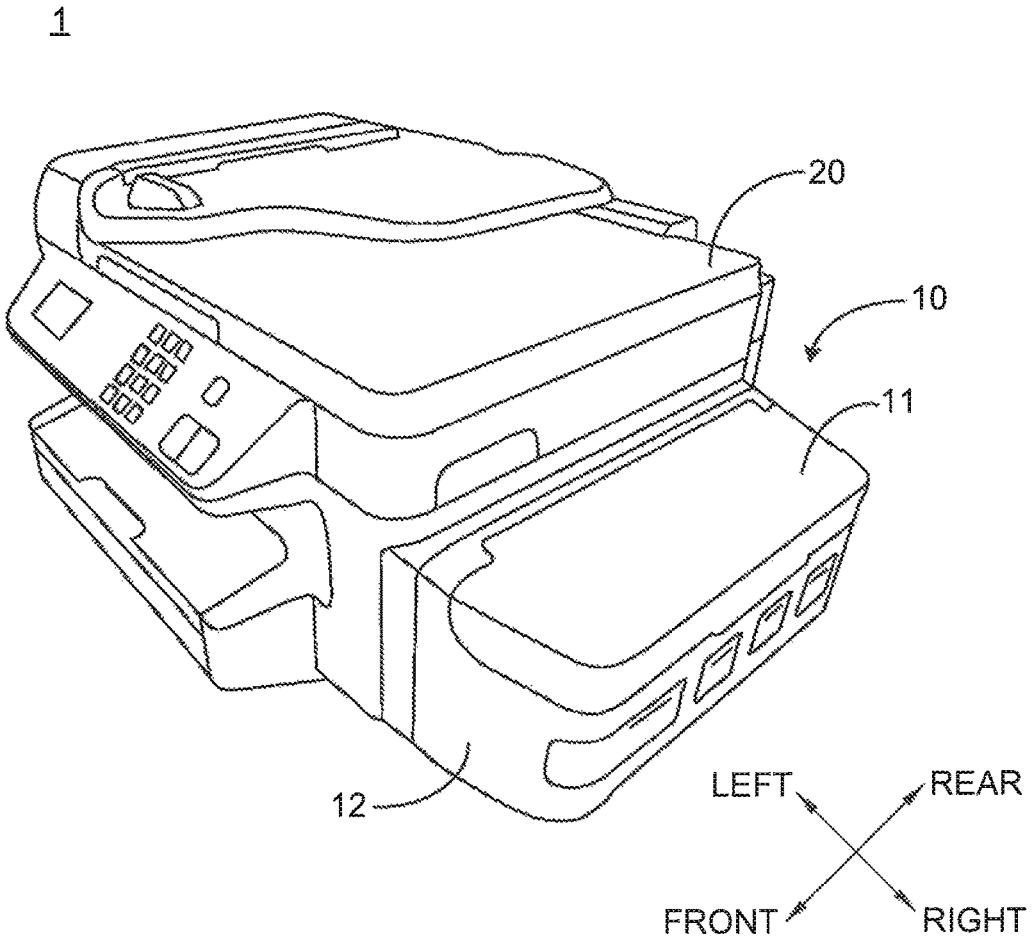
FIG. 1 is a perspective view depicting a conventional inkjet printer, in which a cover is closed.
Figure 2:
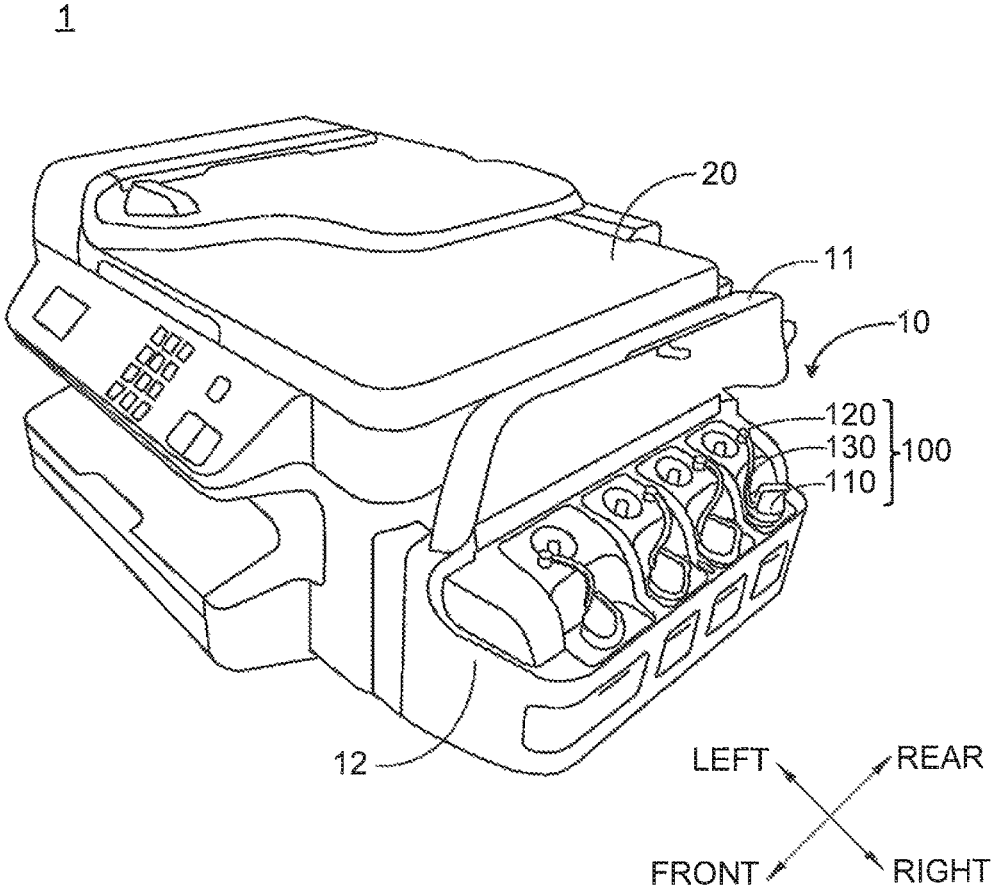
FIG. 2 is a perspective view depicting the inkjet printer of FIG. 1, in which the cover is opened.
Figure 3:
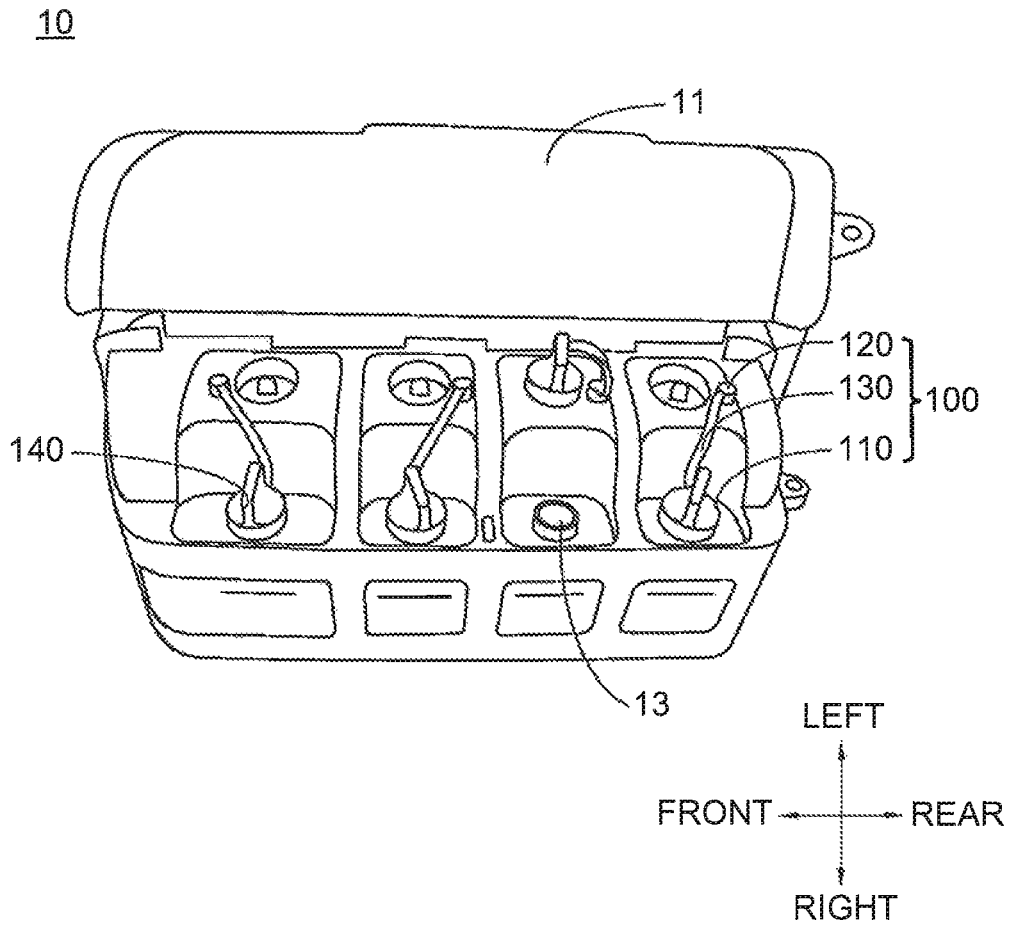
FIG. 3 is a perspective view depicting an ink container of the inkjet printer of FIG. 1, in which the cover is opened.

As depicted in FIGS. 1-3, a conventional inkjet printer 1 includes a printer body 20 and an ink container 10. The ink container 10 is fixed to or detachably attached to the printer body 20. The printer body 20 has a substantially rectangular parallelepiped shape. The ink container 10 is disposed on a right side surface of the printer body 20 and extends rightward from the right side surface of the printer body 20. It should be appreciated that although the ink container 10 is disposed on the right side of the printer body 20 in the illustrated embodiment, the ink container 10 may be fixed to the printer body 20 as shown in FIGS. 1-3, and may also be detachably attached to the printer body 20, according to the actual needs.

The ink container 10 includes an ink container body 12 configured to contain ink to be supplied to the printer body 20. The ink container body 12 includes four ink containing portions (not shown), each of which is configured to contain ink of different colors, such as black, cyan, magenta, and yellow, to be used to record a color image. The ink container body 12 may include six, eight, or twelve ink containing portions to record the color image using six, eight, or twelve colors of ink, respectively.

As depicted in FIG. 3, each of the ink containing portions includes a refill portion through which allows the user to pour ink into the ink containing portion. The refill portion includes a refill port 13 and a sealing member 100 configured to seal the refill port 13. The refill port 13 typically has a cylindrical shape, which protrudes from an upper surface of the ink containing portion and has an opening opened upward. The sealing member 100 will be described below in detail.

The ink container 10 further includes a cover 11. The cover 11 has a substantially plate shape and is connected to the ink container body 12 such that the cover 11 is pivotable about a pivot axis. The pivot axis extends along a front-rear direction of the ink container 10. Specifically, the cover 11 is pivotable between a closed position and an opened position with respect to the ink container body 12. As depicted in FIG. 1, when the cover 11 is in the closed position, the cover 11 covers the refill portion. As depicted in FIGS. 2 and 3, when the cover 11 is in the opened position, the refill portion is exposed. The user may pour ink in the refill port 13 after pivoting the cover 11 from the closed position to the opened position to expose the refill portion.

As depicted in FIG. 4A-4D, a conventional sealing member 100 includes a main body portion 110 and a protruding portion 140. The main body portion 110 is shaped to cap and fit the refill port 13 to seal the refill port 13. For ease of user operation, the main body portion 110 generally has a particular shape rotationally symmetrical around a central axis CA1. Specifically, the main body portion 110 includes a sealing portion 150 and a covering portion 160. The sealing portion 150 is configured to be inserted into the refill port 13 and may have a hollow cylindrical shape. The outer diameter of the sealing portion 150 is slightly larger than the inner diameter of the refill port 13. The covering portion 160 may also have a hollow cylindrical shape. The inner diameter of the cylindrical portion of the covering portion 160 is slightly larger than the outer diameter of the refill port 13. The sealing member 100 may entirely be made of an elastic material such as silicone or rubber. Thus, when the sealing portion 150 of the sealing member 100 is inserted into the refill port 13, the refill port 13 is sealed by elastic deformation of the sealing portion 150.

The protruding portion 140 is disposed on an upper surface 111 of the main body portion 110 and protrudes from the upper surface 111 of the main body portion 110. The user can hold the protruding portion 140 with his/her fingers to operate the sealing member 100. The protruding portion 140 extends through the central axis CA1 of the main body portion 110.

Further, the sealing member 100 may include a connecting portion 130 and a fixed portion 120. The connecting portion 130 may connect the main body portion 110 and the fixed portion 120. The fixed portion 120 is anchored to the ink container 10 so that the entire sealing member 100 may not be separated from the ink container 10 when the main body portion 110 is removed from the refill port 13.

Figure 4A:
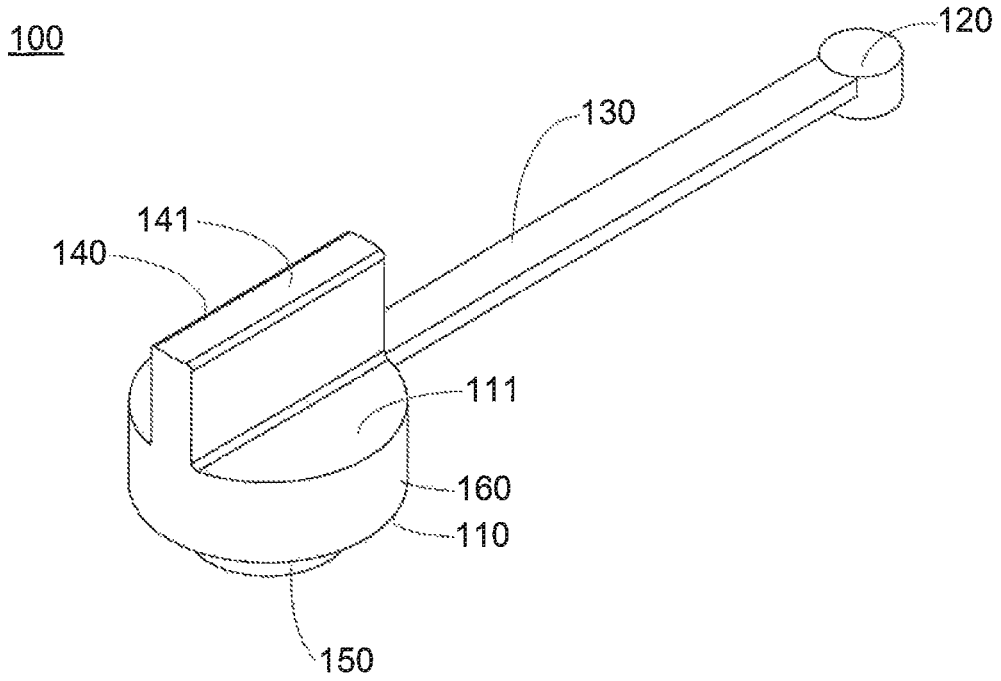
FIG. 4A is a perspective view depicting a conventional sealing member.
Figure 4B:
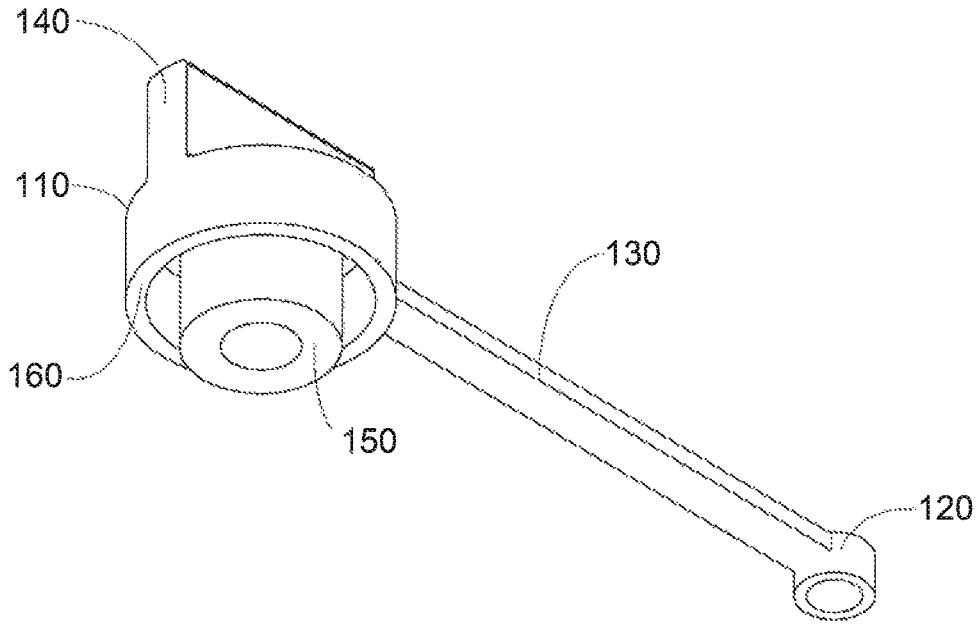
FIG. 4B is another perspective view depicting the sealing member of FIG. 4A.
Figure 4C:
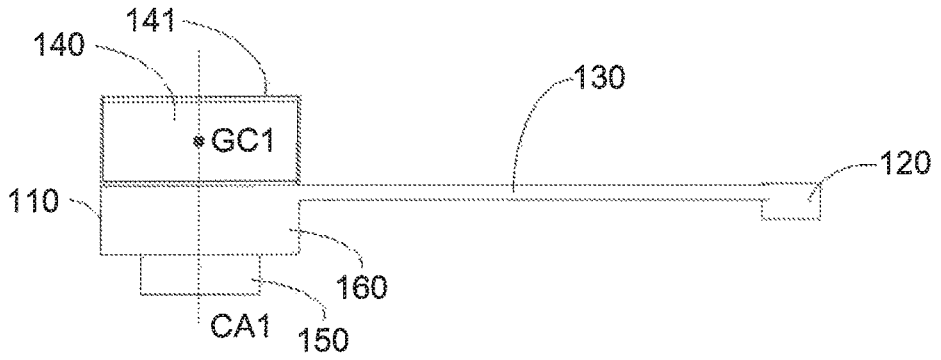
FIG. 4C is a longitudinal sectional view depicting the sealing member of FIG. 4A.
Figure 4D:
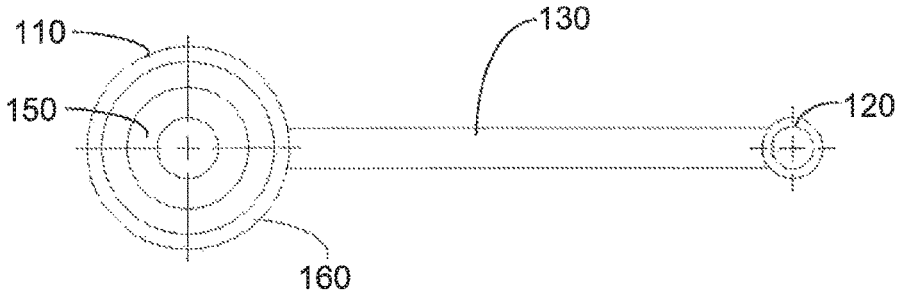
FIG. 4D is a bottom perspective view depicting the sealing member of FIG. 4A.

As depicted in FIG. 4C, a position of a center of gravity GC1 of the protruding portion 140 may be on the central axis CA1, and the center of gravity GC1 of the protruding portion 140 is on the central axis CA1 of the main body portion 110. Thus, when the user holds the protruding portion 140, the protruding portion 140 may be pulled in any direction to remove the sealing member 100 from the refill port 13. As a result, the ink adhering to the main body portion 110 splashes around.

Figure 5A:
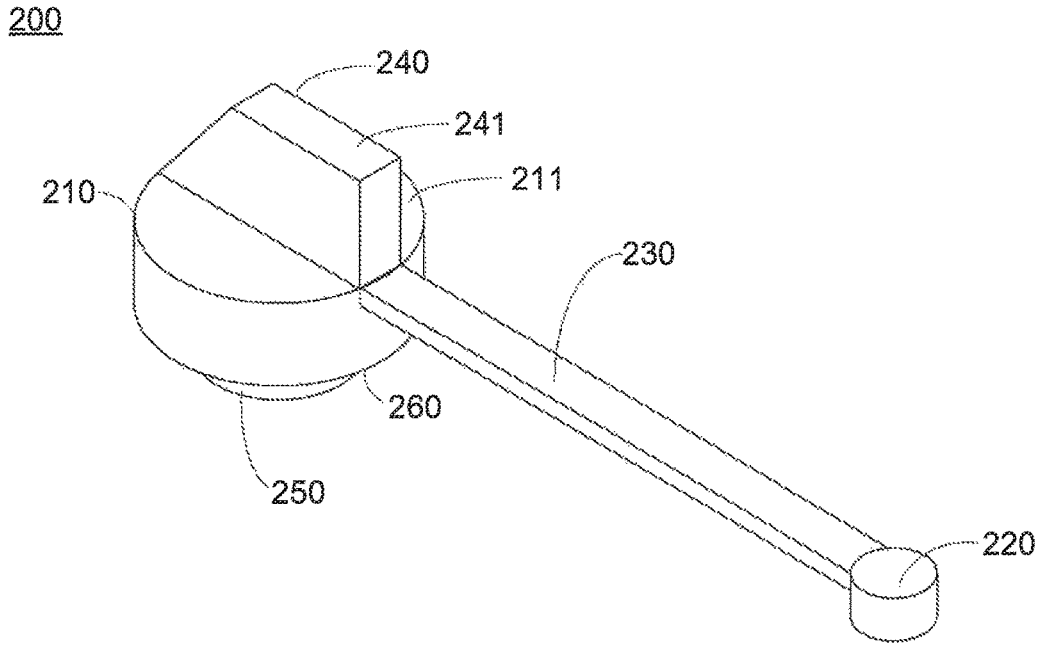
FIG. 5A is a perspective view depicting a sealing member in a first illustrative embodiment according to one or more aspects of the disclosure.
Figure 5B:
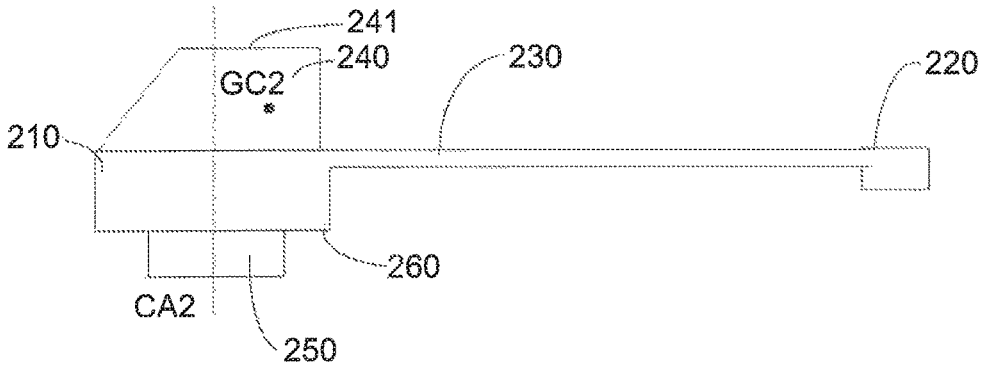
FIG. 5B is a longitudinal sectional view depicting the sealing member of FIG. 5A.

FIGS. 5A and 5B depict a sealing member 200, that is one example of the sealing member 100, in the first embodiment according to one or more aspects of the disclosure.

The sealing member 200 includes a main body portion 210 and a protruding portion 240. The main body portion 210 is shaped to cap and fit the refill port 13 to seal the refill port 13. For ease of user operation, the main body portion 210 generally has a particular shape rotationally symmetrical around a central axis CA2. Specifically, the main body portion 210 includes a sealing portion 250 and a covering portion 260. The sealing portion 250 is configured to be inserted into the refill port 13 and may have a hollow cylindrical shape. The outer diameter of the sealing portion 250 is slightly larger than the inner diameter of the refill port 13. The covering portion 260 may also have a hollow cylindrical shape. The inner diameter of the cylindrical portion of the covering portion 260 is slightly larger than the outer diameter of the refill port 13. The sealing member 200 may entirely be made of an elastic material such as silicone or rubber. Thus, when the sealing portion 250 of the sealing member 200 is inserted into the refill port 13, the refill port 13 is sealed by elastic deformation of the sealing portion 250.

The protruding portion 240 is disposed on an upper surface 211 of the main body portion 210 and protrudes from the upper surface 211 of the main body portion 210. The user can hold the protruding portion 240 with his/her fingers to operate the sealing member 200. The protruding portion 240 extends through the central axis CA2 of the main body portion 210.

Further, the sealing member 200 may include a connecting portion 230 and a fixed portion 220. The connecting portion 230 may connect the main body portion 210 and the fixed portion 220. The fixed portion 220 is anchored to the ink container 10 so that the entire sealing member 200 may not be separated from the ink container 10 when the main body portion 210 is removed from the refill port 13.

In the first embodiment, a position of a center of gravity GC2 of the protruding portion 240 may not be on the central axis CA2 but offset from the central axis CA2 of the main body portion 210. Thus, when the user holds the protruding portion 240, the protruding portion 240 may be pulled in a predetermined direction to remove the sealing member 200 from the refill port 13. As a result, the ink adhering to the main body portion 210 splashes in the intended direction instead of splashing around.

The protruding portion 240 includes a first portion and a second portion. The central axis CA2 is at a border of the first portion and the second portion. A height of some part of the first portion is less than a height of the second portion and a width of the first portion is identical to a width of the second portion such that a volume of the second portion is greater than a volume of the first portion and the center of gravity GC2 is positioned in the second portion of the protruding portion 240.

In the first embodiment, a distance between the center of gravity GC2 of the protruding portion 240 and the connecting portion 230 is less than a distance between the central axis CA2 and the connecting portion 230. Thus, the user may hold a particular portion, near the connecting portion 230, of the protruding portion 240 to separate the main body portion 210 from the refill port 13 in a direction toward the connecting portion 230. The particular portion of the main body portion 210 may be first separated from the refill port 13, and then the other portion of the main body portion 210 may be separated from the refill port 13.

The above-described configuration of the sealing member 200 enables the user to easily hold the second portion of the main body portion 210. Thus, when the user removes the sealing member 200 from the refill port 13, rotational motion may occur in the sealing member 200, and ink may splash along the expected direction, not splash around.

In the first embodiment, a cross section of the main body portion 210 is circular, and the protruding portion 240 extends in a radial direction of the main body portion 210. Thus, the protruding portion 240 extends through the central axis CA2 of the main body portion 210. Further, a longitudinal cross section of the protruding portion 240 is trapezoidal, and the protruding portion 240 has an upper surface 241 with different heights depending on positions. Thus, the user may hold a higher portion of the trapezoidal protruding portion 240. The longitudinal cross section of the protruding portion 240 may be a polygon, a curved segment, and a polygon including a curved segment so long as the center of gravity GC2 is positioned in the second portion of the protruding portion 240.

One end portion of the protruding portion 240 and the edge of the main body portion 210 are coplanar. This structure increases good touch feeling and reduces sharpness so as to not stimulate the fingertip. Thus, the user may feel comfortable when removing the main body portion 210 from the refill port 13 in the intended direction.

Furthermore, a height of the one end portion of the protruding portion 240, which is coplanar with the edge of the main body portion 210, protrudes from the upper surface 211 of the main body portion 210 is greater than any other portion of the protruding portion 240. Thus, the protruding portion 240 has simple structure for manufacturing. Thus, the user may hold the one end portion of the protruding portion 240 and may feel comfortable when removing the sealing portion 250 from the refill port 13 in the intended direction.

When removing the sealing portion 250, the user may hold the higher portion of the protruding portion 240. Thus, the higher portion of the protruding portion 240 of the main body portion 210 may be first separated from the refill port 13, thereby preventing the ink adhering to the main body portion 210 (particularly, the sealing portion 250) from splashing around.

Furthermore, the protruding portion 240 extends through where the main body portion 210 is connected to the connecting portion 230. This structure of the protruding portion 240 enables the user to remove the sealing portion 250 from the refill port 13 in the direction toward the connecting portion 230. The protruding portion 240 extends in a direction identical to a direction in which connecting portion 230 extends. By this configuration, the sealing member 200 can be neat. The center of gravity GC2 of the protruding portion 240 is close to the connecting portion 230 with respect to the central axis CA2 of the main body portion 210. When the user removes the sealing portion 250, the connecting portion 230 may primarily receive a straight force along the direction in which the connecting portion 230 extends and may not receive a radial force for twisting the connecting portion 230 so as to not be damaged easily.

The user may hold the higher portion of the protruding portion 240 for removing the sealing portion from the refill port 13. Thus, the higher portion of the protruding portion 240 of the main body portion 210 may be first separated from the refill port 13, so that the ink adhering to the main body portion 210 (particularly, the sealing portion 250) can splash in a direction toward the connecting portion 230, i.e., generally toward an upwardly-extending wall or block of the ink container 10, thereby preventing the ink splashing around such that users may not receive ink splash.

Second Embodiment

Figure 6A:
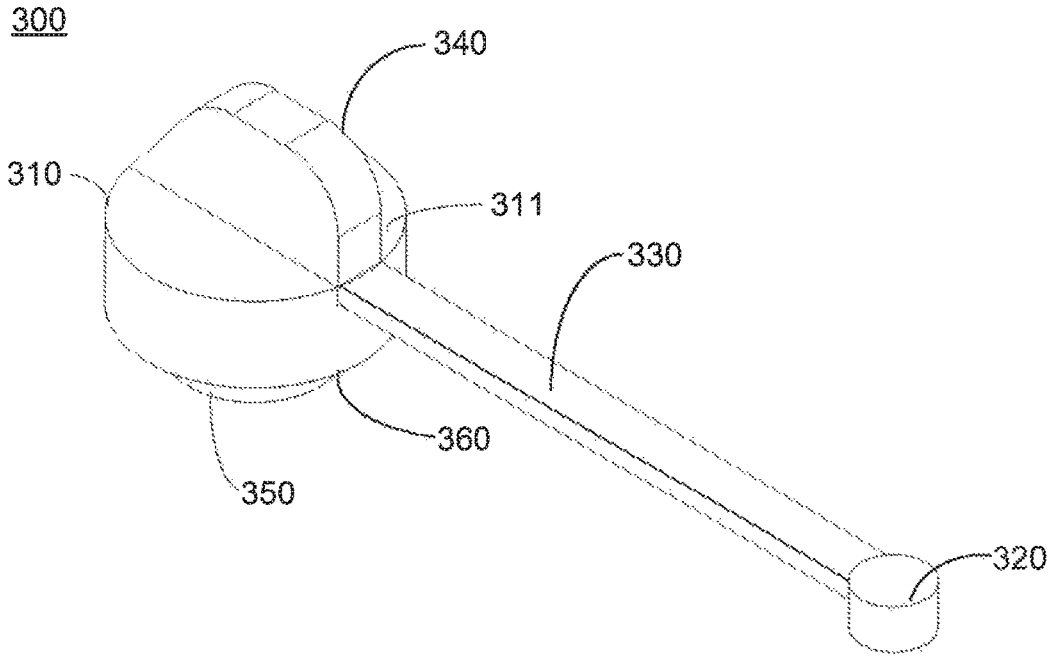
FIG. 6A is a perspective view depicting a sealing member in a second illustrative embodiment according to one or more aspects of the disclosure.
Figure 6B:
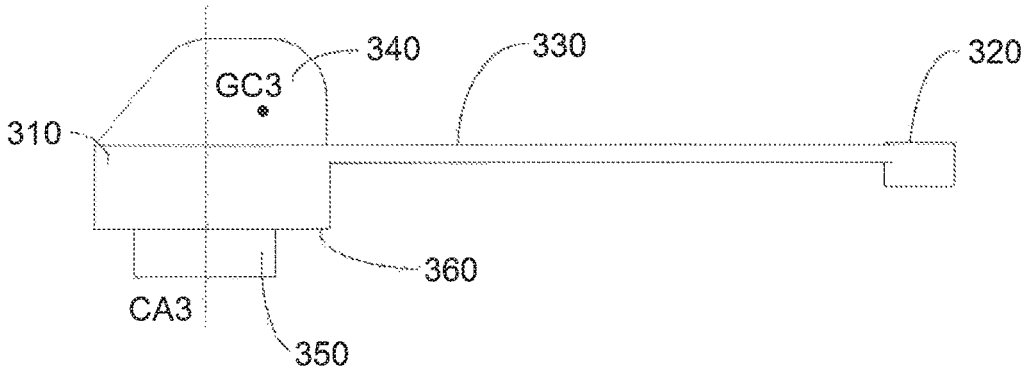
FIG. 6B is a longitudinal sectional view depicting the sealing member of FIG. 6A.

In the second embodiment, as depicted in FIGS. 6A and 6B, the sealing member 300 has substantially the same configuration as the sealing member 200 in the first embodiment. The sealing member 300 includes a main body portion 310 configured to seal the refill port 13, a fixed portion 320 configured to connect to the ink container 10, a connecting portion 330 configured to connect the main body portion 310 and the fixed portion 320, and a protruding portion 340 protruding from an upper surface 311 of the main body portion 310. The main body portion 310 includes a sealing portion 350 and a covering portion 360.

In the second embodiment, the center of gravity GC3 of the protruding portion 340 is close to the connecting portion 330 with respect to the central axis CA3 of the main body portion 310. The protruding portion 340 includes a first portion and a second portion. The central axis CA3 is at a border of the first portion and the second portion. A height of some part of the first portion is less than a height of the second portion and a width of the first portion is identical to a width of the second portion such that a volume of the second portion is greater than a volume of the first portion and the center of gravity GC3 is positioned in the second portion of the protruding portion 340.

The sealing member 300 of the second embodiment is substantially the same as the sealing member 200 of the first embodiment, except that a longitudinal cross section of the protruding portion 340 is trapezoidal with rounded corners. This structure reduces edges and corners, thereby reducing discomfort that the edges and corners may bring to the user.

Third Embodiment

Figure 7A:
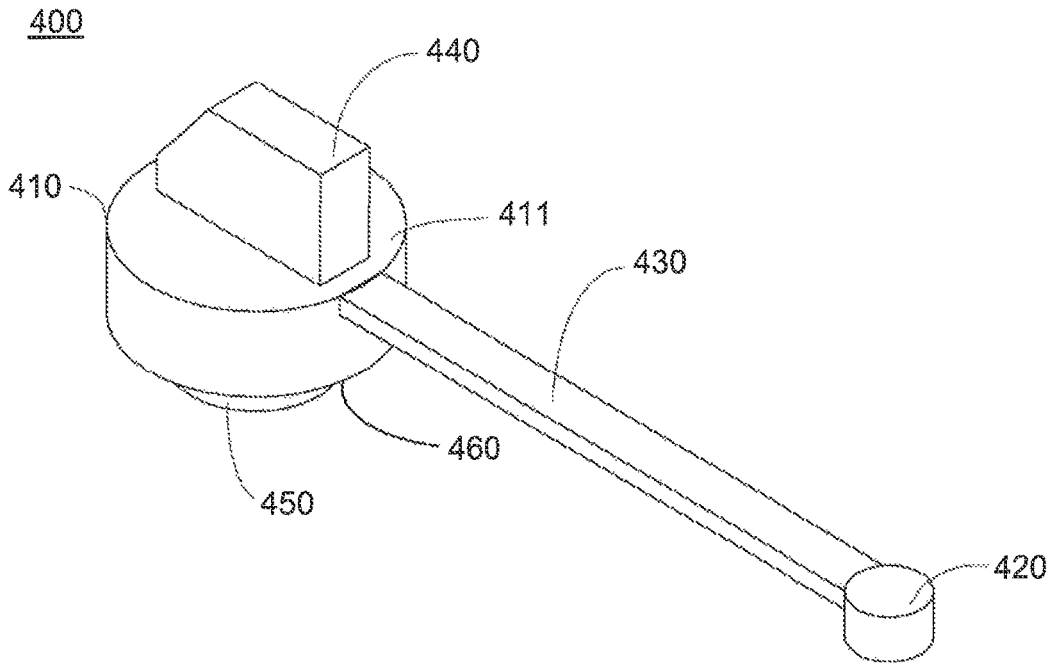
FIG. 7A is a perspective view depicting a sealing member in a third illustrative embodiment according to one or more aspects of the disclosure.
Figure 7B:
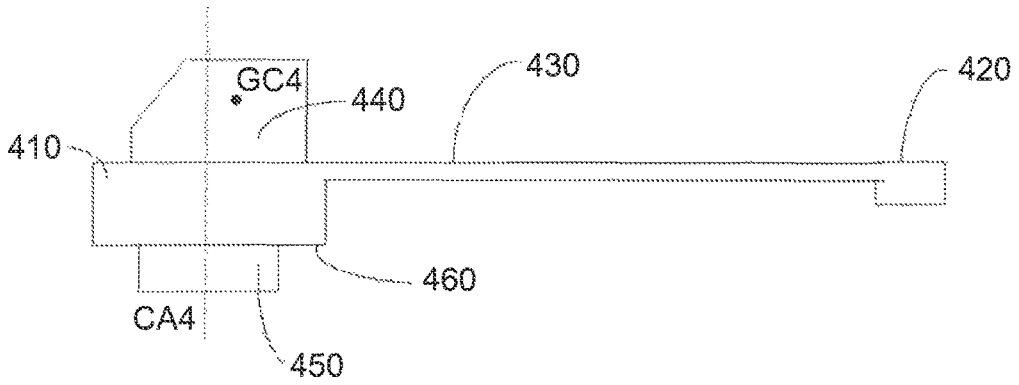
FIG. 7B is a longitudinal sectional view depicting the sealing member of FIG. 7A.

In the third embodiment, as depicted in FIGS. 7A and 7B, the sealing member 400 has substantially the same configuration as the sealing member 200 in the first embodiment. The sealing member 400 includes a main body portion 410 configured to seal the refill port 13, a fixed portion 420 configured to connect to the ink container 10, a connecting portion 430 configured to connect the main body portion 410 and the fixed portion 420, and a protruding portion 440 protruding from an upper surface 411 of the main body portion 410. The main body portion 410 includes a sealing portion 450 and a covering portion 460.

In the third embodiment, the center of gravity GC4 of the protruding portion 440 is close to the connecting portion 430 with respect to the central axis CA4 of the main body portion 410. The protruding portion 440 includes a first portion and a second portion. The central axis CA4 is at a border of the first portion and the second portion. A height of some part of the first portion is less than a height of the second portion and a width of the first portion is identical to a width of the second portion such that a volume of the second portion is greater than a volume of the first portion and the center of gravity GC4 is positioned in the second portion of the protruding portion 440.

The sealing member 400 of the third embodiment is substantially the same as the sealing member 200 of the first embodiment, except that the protruding portion 440 does not extend the main body portion 410 in the entire radius of the main body portion 410. In other words, both end portions of the protruding portion 440 are not coplanar with the round edge of the main body portion 410.

Fourth Embodiment

Figure 8A:
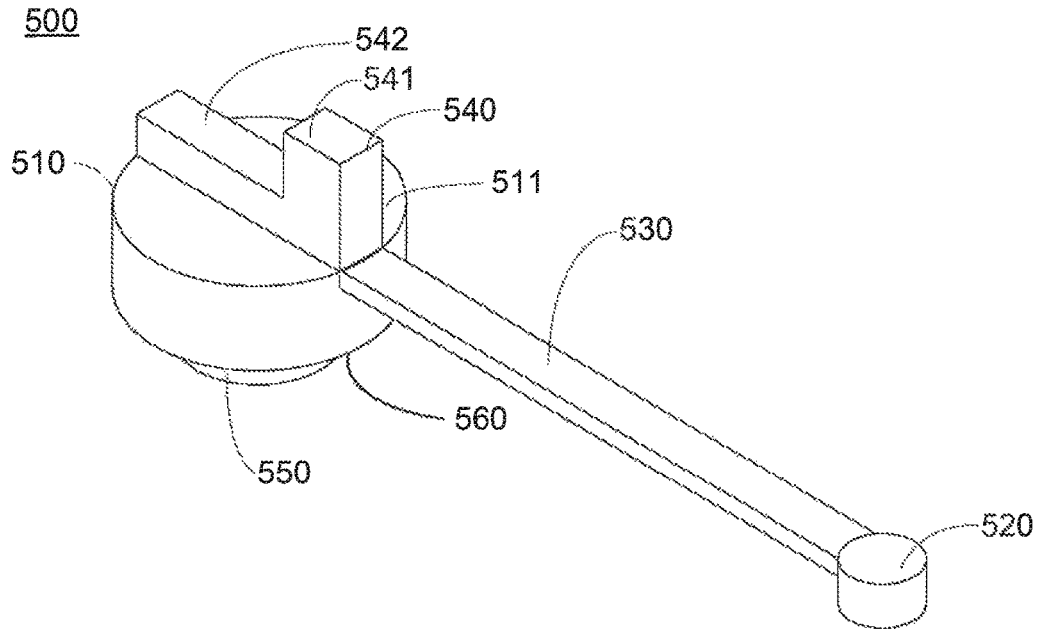
FIG. 8A is a perspective view depicting a sealing member in a fourth illustrative embodiment according to one or more aspects of the disclosure.
Figure 8B:
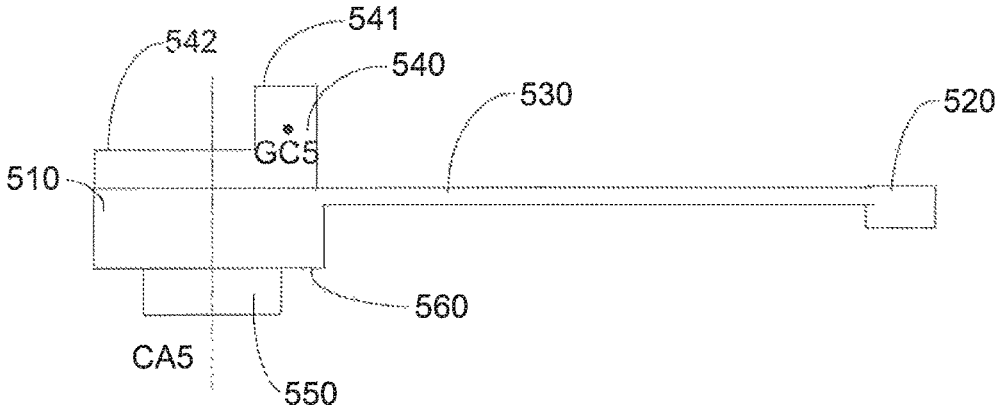
FIG. 8B is a longitudinal sectional view depicting the sealing member of FIG. 8A.

In the fourth embodiment, as depicted in FIGS. 8A and 8B, the sealing member 500 has substantially the same configuration as the sealing member 200 in the first embodiment. The sealing member 500 includes a main body portion 510 configured to seal the refill port 13, a fixed portion 520 configured to connect to the ink container 10, a connecting portion 530 configured to connect the main body portion 510 and the fixed portion 520, and a protruding portion 540 protruding from an upper surface 511 of the main body portion 510. The protruding portion 540 includes a first upper surface 541 and a second upper surface 542. The main body portion 510 includes a sealing portion 550 and a covering portion 560.

In the fourth embodiment, the center of gravity GC5 of the protruding portion 540 is close to the connecting portion 530 with respect to the central axis CA5 of the main body portion 510. The protruding portion 540 includes a first portion and a second portion. The central axis CA5 is at a border of the first portion and the second portion. A height of the first portion is less than the greatest height in the second portion and a width of the first portion is identical to a width of the second portion such that a volume of the second portion is greater than a volume of the first portion and the center of gravity GC5 is positioned in the second portion of the protruding portion 540.

The sealing member 500 of the fourth embodiment is substantially the same as the sealing member 200 of the first embodiment, except that a longitudinal cross section of the protruding portion 540 is step-like. The first upper surface 541 is located in the second portion of the protruding portion 540. Most of the second upper surface 542 is located in the first portion of the protruding portion 540. In the fourth embodiment, the height of the second upper surface 542 of the protruding portion 540 which the central axis CA5 of the main body portion 510 passes through is less than the greatest height of the first upper surface 541 of the protruding portion 540. Thus, the center of gravity GC5 of the protruding portion 540 is positioned near the upper surface 542 and is offset from the central axis CA5 of the main body portion 510.

Fifth Embodiment

Figure 9A:
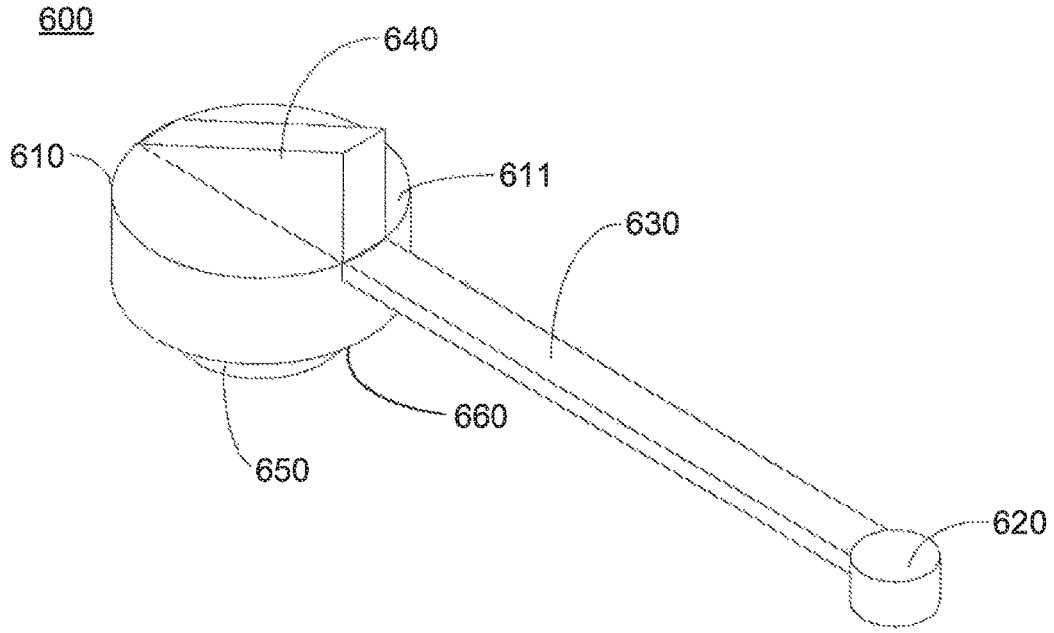
FIG. 9A is a perspective view depicting a sealing member in a fifth illustrative embodiment according to one or more aspects of the disclosure.
Figure 9B:
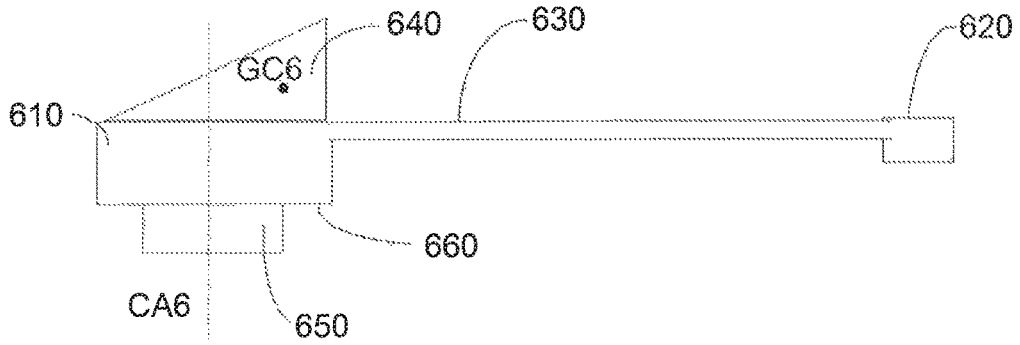
FIG. 9B is a longitudinal sectional view depicting the sealing member of FIG. 9A.

In the fifth embodiment, as depicted in FIGS. 9A and 9B, the sealing member 600 has substantially the same configuration as the sealing member 500 in the fourth embodiment. The sealing member 600 includes a main body portion 610 configured to seal the refill port 13, a fixed portion 620 configured to connect to the ink container 10, a connecting portion 630 configured to connect the main body portion 610 and the fixed portion 620, and a protruding portion 640 protruding from an upper surface 611 of the main body portion 610. The main body portion 610 includes a sealing portion 650 and a covering portion 660.

In the fifth embodiment, the center of gravity GC6 of the protruding portion 640 is close to the connecting portion 630 with respect to the central axis CA6 of the main body portion 610. The protruding portion 640 includes a first portion and a second portion. The central axis CA6 is at a border of the first portion and the second portion.

The sealing member 600 of the fifth embodiment is substantially the same as the sealing member 500 of the fourth embodiment, except that a longitudinal cross section of the protruding portion 640 is triangular. Such configuration of the protruding portion 640 means that a height at any part of the first portion is less than a height at any part of the second portion and a width of the first portion is identical to a width of the second portion such that a volume of the second portion is greater than a volume of the first portion and the center of gravity GC6 is positioned in the second portion of the protruding portion 640.

Sixth Embodiment

Figure 10A:
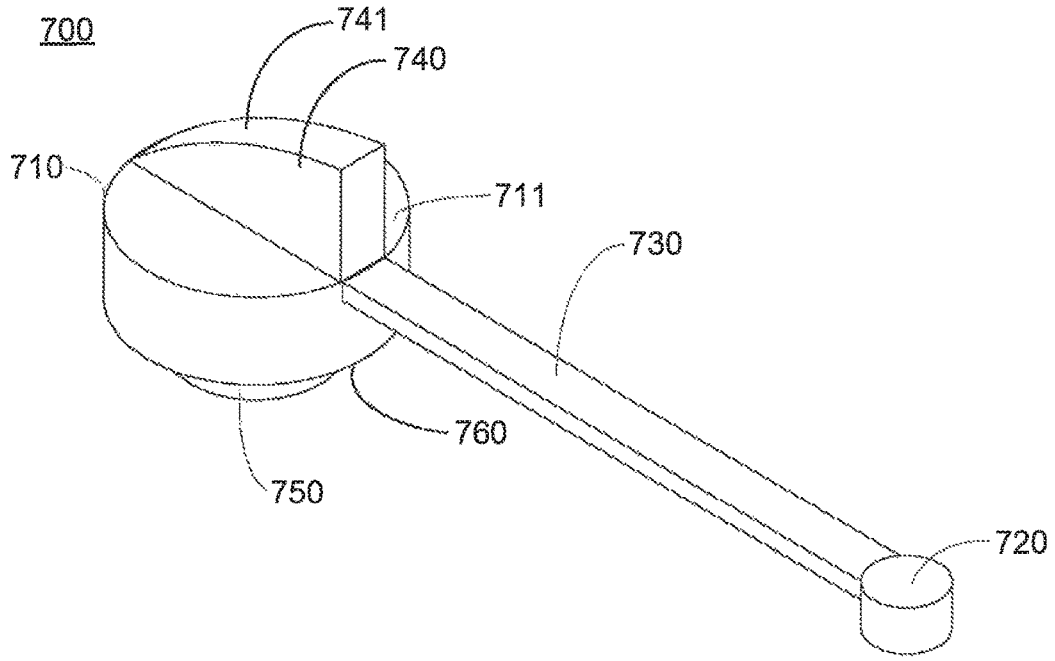
FIG. 10A is a perspective view depicting a sealing member in a sixth illustrative embodiment according to one or more aspects of the disclosure.
Figure 10B:
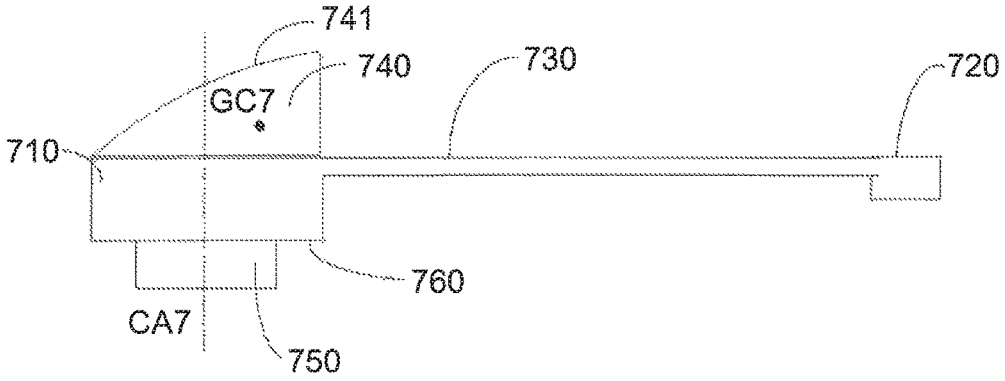
FIG. 10B is a longitudinal sectional view depicting the sealing member of FIG. 10A.

In the sixth embodiment, as depicted in FIGS. 10A and 10B, the sealing member 700 has substantially the same configuration as the sealing member 600 in the fifth embodiment. The sealing member 700 includes a main body portion 710 configured to seal the refill port 13, a fixed portion 720 configured to connect to the ink container 10, a connecting portion 730 configured to connect the main body portion 710 and the fixed portion 720, and a protruding portion 740 protruding from an upper surface 711 of the main body portion 710. The main body portion 710 includes a sealing portion 750 and a covering portion 760.

In the sixth embodiment, the center of gravity GC7 of the protruding portion 740 is close to the connecting portion 730 with respect to the central axis CA7 of the main body portion 710. The protruding portion 740 includes a first portion and a second portion. The central axis CA7 is at a border of the first portion and the second portion.

The sealing member 700 of the sixth embodiment is substantially the same as the sealing member 600 of the fifth embodiment, except that an upper surface 741 of the protruding portion 740 is arc-like. Such configuration of the protruding portion 740 means that a height at any part of the first portion is less than a height at any part of the second portion and a width of the first portion is identical to a width of the second portion such that a volume of the second portion is greater than a volume of the first portion and the center of gravity GC7 is positioned in the second portion of the protruding portion 740.

Seventh Embodiment

Figure 11A:
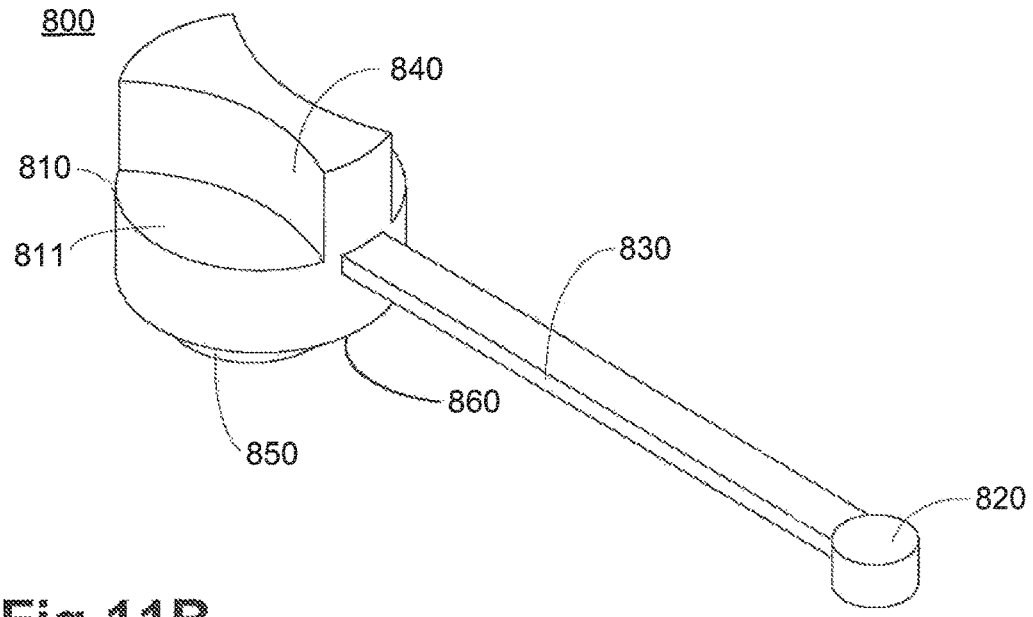
FIG. 11A is a perspective view depicting a sealing member in a seventh illustrative embodiment according to one or more aspects of the disclosure.
Figure 11B:
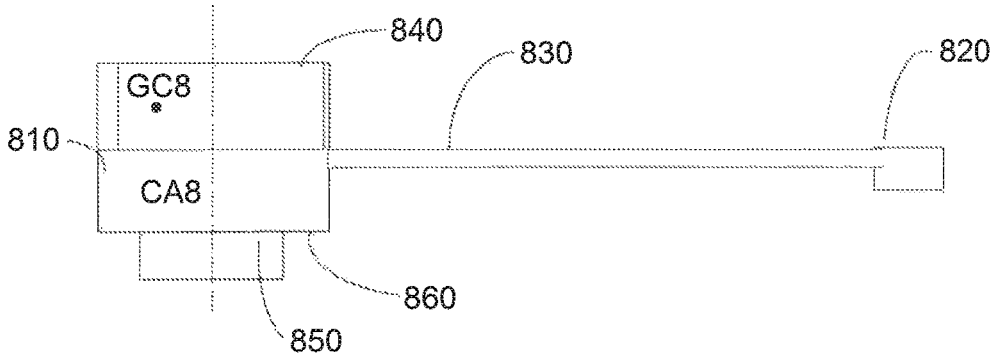
FIG. 11B is a longitudinal sectional view depicting the sealing member of FIG. 11A.

In the seventh embodiment, as depicted in FIGS. 11A and 11B, the sealing member 800 includes a main body portion 810 configured to seal the refill port 13, a fixed portion 820 configured to connect to the ink container 10, a connecting portion 830 configured to connect the main body portion 810 and the fixed portion 820, and a protruding portion 840 protruding from an upper surface 811 of the main body portion 810. The main body portion 810 includes a sealing portion 850 and a covering portion 860.

In the seventh embodiment, the protruding portion 840 is configured such that the center of gravity GC8 of the protruding portion 840 is offset from the central axis CA8 of the main body portion 810.

The sealing member 800 of the seventh embodiment is substantially the same as the sealing members 200, 300, 400, 500, 600, 700 of the first through sixth embodiments, except that a center of gravity GC8 of the protruding portion 840 is away from the connecting portion 830 with respect to the central axis CA8 of the main body portion 810. The protruding portion 840 includes a first portion and a second portion. The central axis CA8 is at a border of the first portion and the second portion. A distance between the center of gravity GC8 of the protruding portion 840 and the connecting portion 830 is greater than a distance between the central axis CA8 and the connecting portion 830. A height of the first portion is identical to a height of the second portion and a width of a part of the first portion is less than a width of the second portion such that a volume of the second portion is greater than a volume of the first portion and the center of gravity GC8 is positioned in the second portion of the protruding portion 840. That is, the protruding portion 840 has a flat surface parallel to the upper surface 811 of the main body portion 810, and the flat surface extends in an entire length of the protruding portion 840. Such configuration provides a large space that enables the user to easily place his/her fingers on the large space, to easily hold the first portion that is close to the connecting portion 830, and then to remove the sealing portion 850 from the refill port 13 in the same way as the above-mentioned first through sixth embodiments.

Eighth Embodiment

Figure 12A:
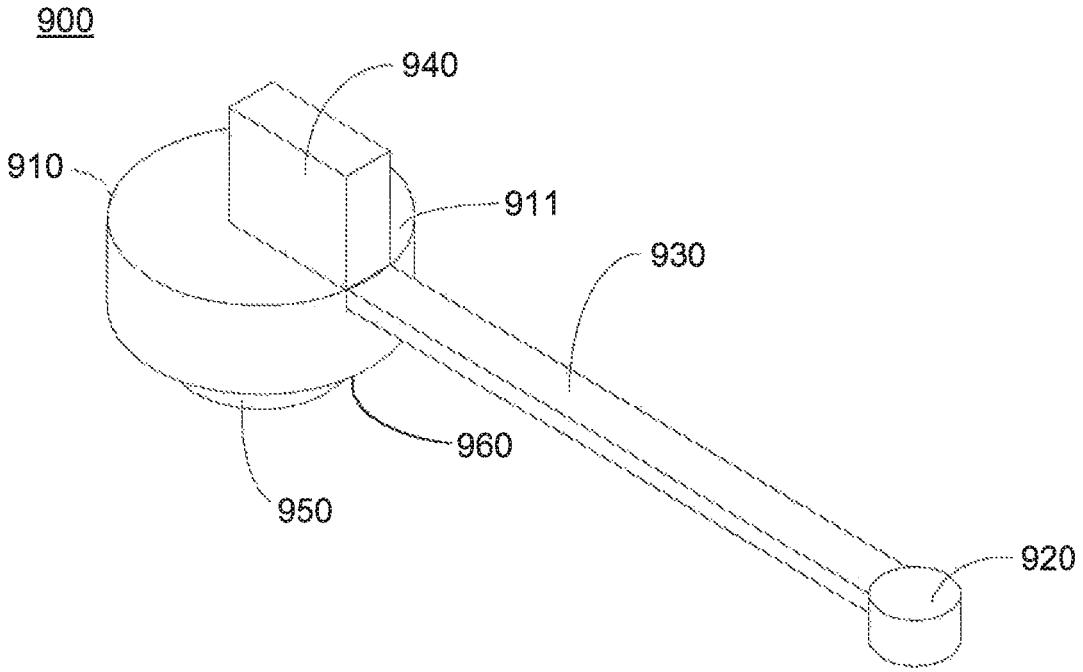
FIG. 12A is a perspective view depicting a sealing member in an eighth illustrative embodiment according to one or more aspects of the disclosure.
Figure 12B:
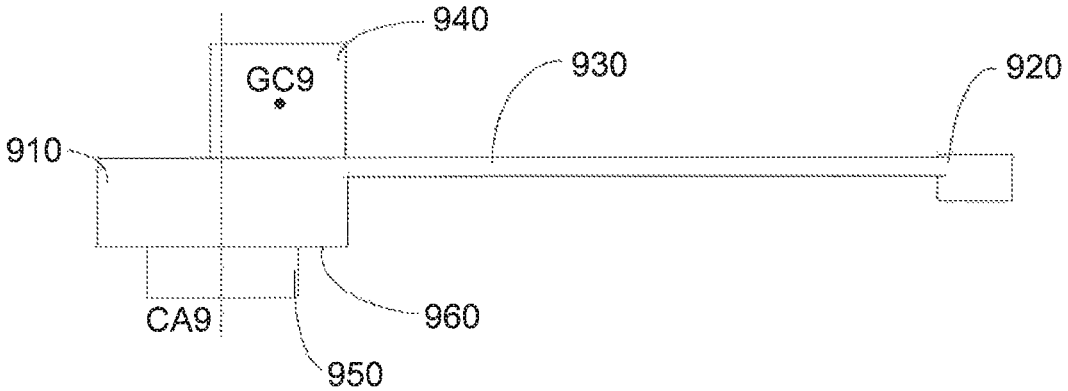
FIG. 12B is a longitudinal sectional view depicting the sealing member of FIG. 12A.

In the eighth embodiment, as depicted in FIGS. 12A and 12B, the sealing member 900 has substantially the same configuration as the sealing member 600 in the fifth embodiment. The sealing member 900 includes a main body portion 910 configured to seal the refill port 13, a fixed portion 920 configured to connect to the ink container 10, a connecting portion 930 configured to connect the main body portion 910 and the fixed portion 920, and a protruding portion 940 protruding from an upper surface 911 of the main body portion 910. The main body portion 910 includes a sealing portion 950 and a covering portion 960.

In the eighth embodiment, the center of gravity GC9 of the protruding portion 940 is close to the connecting portion 930 with respect to the central axis CA9 of the main body portion 910. The protruding portion 940 includes a first portion and a second portion. The central axis CA9 is at a border of the first portion and the second portion.

The sealing member 900 of the eighth embodiment is substantially the same as the sealing member 600 of the fifth embodiment, except that a longitudinal cross section of the protruding portion 940 is rectangular. A height of the first portion is identical to a height of the second portion and a width of the first portion is identical to a width of the second portion. That is, the protruding portion 940 has a flat surface parallel to the upper surface 911 of the main body portion 910, and the flat surface extends in an entire length of the protruding portion 940. However, a length of the first portion is less than a length of the second portion such that a volume of the second portion is greater than a volume of the first portion and the center of gravity GC9 is positioned in the second portion of the protruding portion 940. Thus, the user may remove the sealing portion 950 from the refill port 13 in the same way as the above-mentioned embodiments.

The present disclosure describes an ink container, which includes the above-mentioned sealing member. The ink container according to the present disclosure enables the user to remove the sealing member from the refill port in the intended direction, thereby reducing contaminating other parts of the ink container.

Furthermore, the present disclosure describes an inkjet printer, which includes the above-mentioned ink container. The inkjet printer according to the present disclosure enables the user to remove the sealing member from the refill port in the intended direction, thereby reducing contaminating other parts of the inkjet printer.

While the disclosure has been described in detail with reference to the specific embodiments thereof, these are merely examples, and various changes, arrangements and modifications may be applied therein without departing from the spirit and scope of the disclosure.

What is claimed is:

1. A sealing member for an ink container of an inkjet printer, the ink container including a refill port, the sealing member comprising:

a cylindrical main body portion configured to seal the refill port; and a protruding portion disposed on an upper surface of the main body portion and protruding from the upper surface of the main body portion, the protruding portion extending at least through a central axis of the main body portion, wherein a center of gravity of the protruding portion is laterally offset from the central axis of the main body portion.

2. The sealing member according to claim 1, wherein the protruding portion has a first upper surface and a second upper surface, and the height of the second upper surface is less than the greatest height of the first upper surface.

3. The sealing member according to claim 1, wherein the protruding portion has a flat surface parallel to the upper surface of the main body portion, the flat surface extending in an entire length of the protruding portion.

4. The sealing member according to claim 3, further comprising:

a fixed portion through which the sealing member is detachably attached to the ink container; and a connecting portion connecting the main body portion and the fixed portion, wherein the center of gravity of the protruding portion is laterally offset towards the connecting portion with respect to the central axis of the main body portion.

5. The sealing member according to claim 3, further comprising:

a fixed portion through which the sealing member is detachably attached to the ink container; and a connecting portion connecting the main body portion and the fixed portion, wherein the center of gravity of the protruding portion is laterally offset away from the connecting portion with respect to the central axis of the main body portion.

6. The sealing member according to claim 4, wherein an extending direction of the protruding portion passes through a connecting point of the main body portion and the connecting portion.

7. The sealing member according to claim 5, wherein an extending direction of the protruding portion passes through a connecting point of the main body portion and the connecting portion.

8. An ink container for an inkjet printer, the ink container comprising a sealing member of claim 1.

9. An inkjet printer comprising an ink container of claim 8.

10. A cap member comprising:

a cylindrical main body; and a protruding portion disposed on an upper surface of the main body and protruding from the upper surface of the main body portion, the protruding portion extending through a central axis of the main body portion, wherein a center of gravity of the protruding portion is laterally offset from the central axis of the main body portion.

11. The cap member according to claim 10, wherein the main body is rotationally symmetrical around the central axis.

12. The cap member according to claim 11, wherein the protruding portion includes a first portion on one side of the central axis and a second portion on the other side of the central axis, a volume of the second portion is greater than a volume of the first portion, and the center of gravity of the protrusion is in the second portion.

13. The cap member according to claim 12, wherein a width of the first portion is identical to a width of the second portion, and a height of the second portion is greater than a height of the first portion.

14. The cap member according to claim 12, wherein a width of the second portion is greater than a width of the first portion, and a height of the first portion is identical to a height of the second portion.

15. The cap member according to claim 12, further comprising:

an anchor portion; and a connecting portion connecting the main body portion and the anchor portion;

wherein a distance between the second portion and the connecting portion is less than a distance between the central axis and the connecting portion.

16. The cap member according to claim 12, further comprising:

an anchor portion; and a connecting portion connecting the main body portion and the anchor portion;

wherein a distance between the second portion and the connecting portion is greater than a distance between the central axis and the connecting portion.

* * * * *